United States Patent [19]

Dietrich

[11] Patent Number: 4,974,884

[45] Date of Patent: Dec. 4, 1990

[54] SELECTIVE SELF-LOCKING DEADBOLT LATCH

[75] Inventor: Hagen Dietrich, St. Burnaby, Canada

[73] Assignee: Masco Building Products Corp., Taylor, Mich.

[21] Appl. No.: 454,878

[22] Filed: Dec. 22, 1989

[51] Int. Cl.[5] ..... E05C 1/16

[52] U.S. Cl. ..... 292/173; 292/335; 292/153; 292/DIG. 4

[58] Field of Search ..... 292/173, 335, 153, DIG. 4, 292/74

[56] References Cited

U.S. PATENT DOCUMENTS

| | | | |
|---|---|---|---|
| 1,636,868 | 7/1927 | Schlegel | 292/163 |
| 2,369,873 | 2/1945 | Voight | 292/169.14 |
| 2,564,161 | 8/1951 | Koreska | 292/335 |
| 2,803,479 | 8/1957 | Young et al. | 292/169.15 |
| 2,865,666 | 12/1958 | Kubik | 292/163 |
| 3,222,097 | 12/1965 | Behrmann | 292/169.14 X |
| 3,799,592 | 3/1974 | Babb, Jr. et al. | 292/169.15 X |
| 3,917,329 | 11/1975 | Fujiki et al. | 292/163 |
| 4,602,490 | 7/1986 | Glass et al. | 292/169 |
| 4,712,396 | 12/1987 | Cary et al. | 70/129 |

*Primary Examiner*—Richard E. Moore

*Attorney, Agent, or Firm*—Edgar A. Zarins; Malcolm L. Sutherland

[57] ABSTRACT

A selectively self-locking deadbolt latch for incorporation into doors or the like. The latch can be preliminarily "armed" such that as the door closes the bolt will extend into the opening of the door strike. The latch mechanism includes a cam lever having a shoulder which loads against the bolt extension. A compression spring within the bolt urges the bolt towards the locked position once the cam lever is released from the bolt extension by closing the door. The temporary retraction of the bolt as it engages the door strike releases the bolt and cam lever. A beam spring acting on the cam lever urges the cam lever forward towards the locked position. The bolt is initially armed by turning the inner turn lever slightly or by depressing the end of the bolt which includes chamfered edges to allow the bolt to move past the door strike for release.

18 Claims, 4 Drawing Sheets

SELECTIVE SELF-LOCKING DEADBOLT LATCH

BACKGROUND OF THE INVENTION

I. Field of the Invention

This invention relates to a deadbolt latch mechanism for a door and, in particular, to a deadbolt latch which can be selectively triggered to be self-locking upon closing the door eliminating independently locking the deadbolt.

II. Description of the Prior Art

Deadbolt locks are widely used, particularly on residential doors, to securely prevent unauthorized entry. The configuration of the deadbolt deters tampering to provide secure latching. Typically, deadbolt latches require a key to be opened from the outside and either a key or a finger lever to be opened from the inside. As a result, the door must be closed and the key utilized to lock the deadbolt. Because of the inconvenience of loading the proper key, many users forego locking the deadbolt unless they will be away from home for extended periods of time.

Deadbolt latches have been developed which allow the user to lock the deadbolt without requiring the use of a key but prevents unlocking except in the conventional manner. In one prior known deadbolt, the bolt is latched using a secondary lever which controls extension of the bolt. Other prior deadbolt latches involve preloading the bolt through rotation of the turn lever beyond its normal position such that upon closing the door the bolt is released into the striker plate. Because of the complexity of the prior self-locking mechanisms, a great deal of additional mechanical structure is incorporated substantially increasing manufacturing costs. Moreover, it is desirable to conventionalize door locks so that they can be interchanged without concern. Modern latches are provided with well known mechanisms. The prior known self-locking deadbolt latches vary the configuration.

SUMMARY OF THE PRESENT INVENTION

The present invention overcomes the disadvantages of the prior known deadbolt latch mechanisms by providing a simple to use self-locking deadbolt which does not incorporate extraneous structure.

The selectively self-locking deadbolt of the present invention allows the user to preset or "load" the latch such that upon closing the door the deadbolt extends into the strike. A specific key from the outside or manipulation of the turn lever from the inside is needed to unlock the latch mechanism. The bolt is loaded by either rotating the inner turn lever slightly to partially extend the bolt or by pushing on the end of the bolt when it is in its retracted position. This moves the bolt from a fully retracted interlock position to the loaded position slightly extended from the door. When the door is closed the engagement of the bolt against the strike unloads the latch causing the bolt to extend into the strike opening. The conventional key or hand lever may thereafter be used to unlock the latch and door.

The selectively self-locking deadbolt latch of the present invention generally includes a housing formed by a pair of cooperating housing portions, a bolt selectively extendable within the housing, a bolt extension secured at one end to the bolt and engaging an actuating cam pivotable within the housing. A cam spring attached to the housing engages the actuating cam to maintain the cam in the extended or retracted position while also urging the cam towards the extended position once the latch is loaded for locking. The present invention incorporates embodiments to accommodate different backset door apertures.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
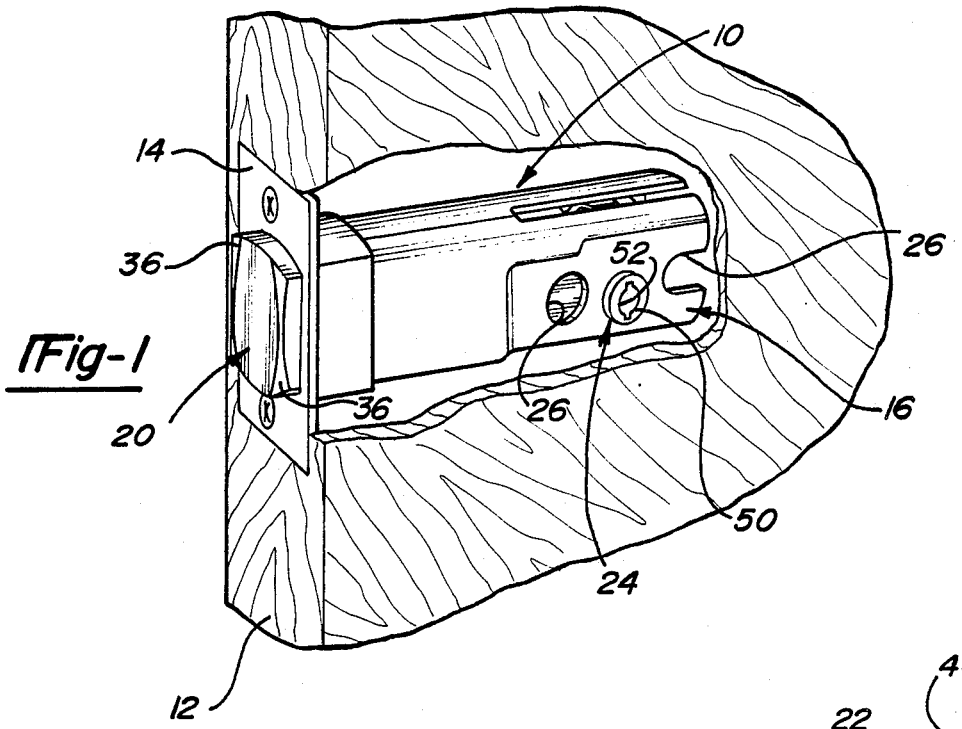
FIG. 1 is a perspective view of the selectively self-locking deadbolt latch embodying the present invention positioned within an entry door.
Figure 2:
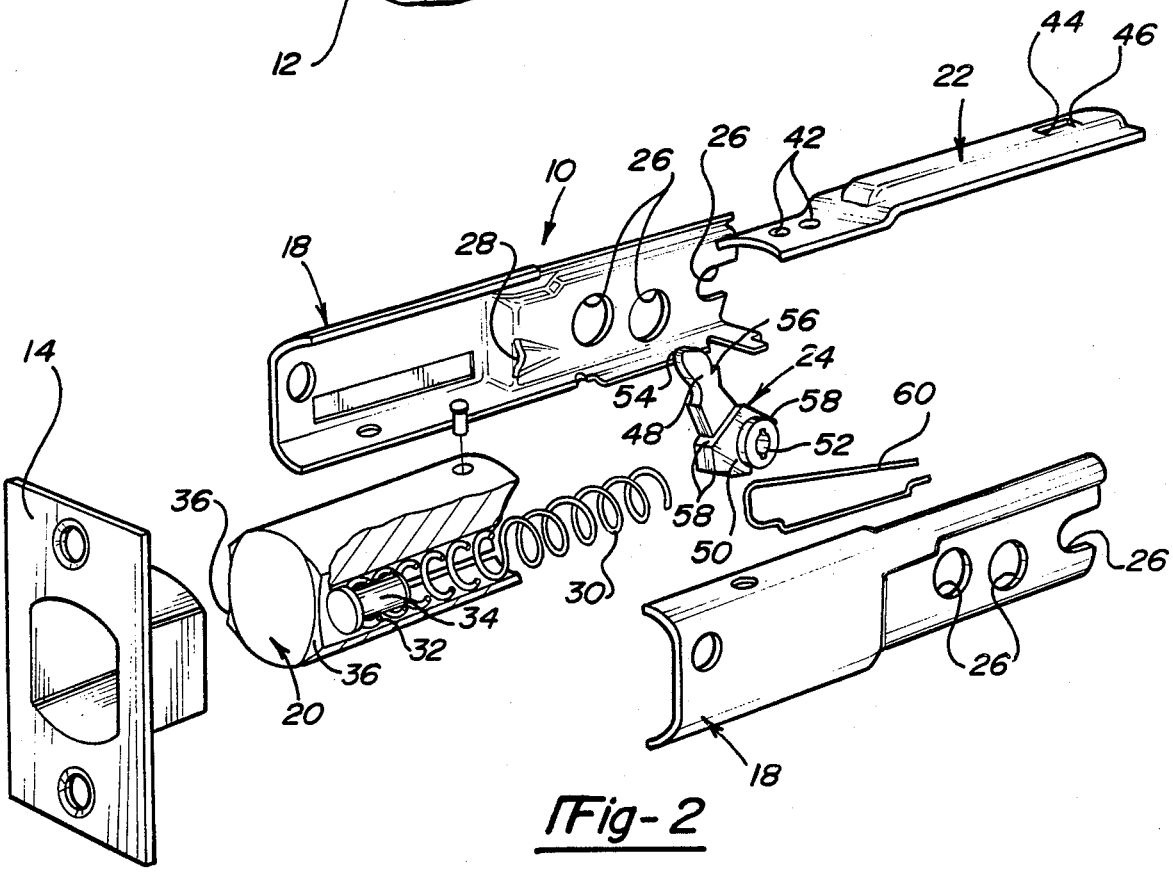
FIG. 2 is an exploded view of a preferred embodiment of the latch of the present invention.
Figure 3:
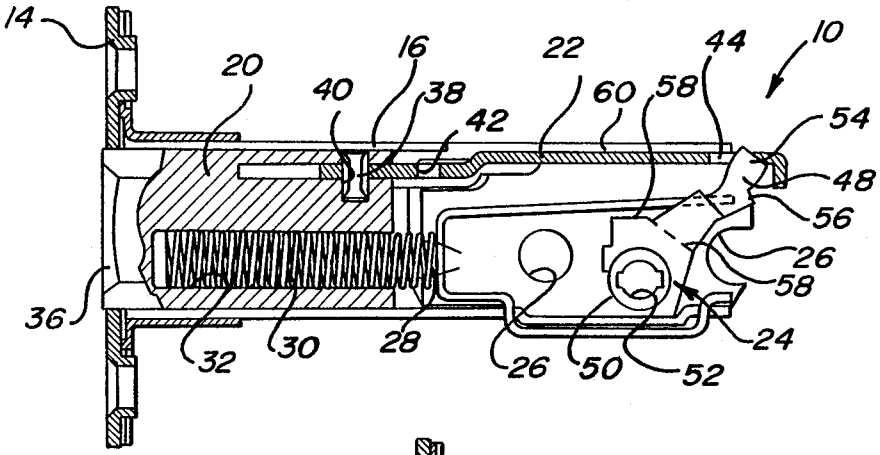
FIG. 3 is a cross-sectional view of the latch in the fully retracted position.

Referring first to FIGS. 1 and 2 there is shown a first embodiment of a selectively self-locking latch mechanism 10 of the present invention. The latch mechanism 10 is adapted to be mounted within a door 12 and operated using a turn handle or key (not shown) for latching and unlatching. The mechanism 10 of the present invention is contemplated to be used as a deadbolt latch and is provided with openings to accommodate different backsets of the door 12. The latch includes a face plate 14 securable to the door edge and preferably a strike plate (not shown) secured to the door frame for latching the mechanism 10 and prevent opening of the door 12.

The latch mechanism 10 generally comprises a housing 16 formed by a pair of cooperating housing halves 18, a bolt 20 shiftable between a fully retracted position and a fully extended position as will be subsequently described, a bolt extension 22 attached to and shiftable with the bolt 20, and an actuating cam 24 which is pivotable as the operating handle or key is rotated to retract and extend the bolt 20. The housing halves 18 are provided with a plurality of laterally aligned openings 26 positioned according to the backset requirements of the door 12. An intermediate opening 26 rotatably receives the actuating cam 24 and through which the operating rod of the operating means extends. A pair of outwardly disposed openings 26 allow the mounting bolts of the latch 10 to pass through the housing 16 for securing the mechanism 10 within the door 12.

Referring now to FIGS. 2 through 7, the housing 16 also includes an internal flange 28 which acts as an abutment surface for one end of a compression spring 30 extending into the bolt 20. The other end of the spring 30 is received within a bore 32 to bias the bolt 20 towards its fully extended position. A security pin 34 within the bore 32 prevents the bolt 20 from being cut for unauthorized access. The end of the bolt 20 is provided with chamfered edges 36 to facilitate self-locking as the bolt 20 engages the strike as will be subsequently described.

The bolt extension 22 is connected to the bolt 20 by a removable pin 38 which is received through a bore 40 of the bolt 20 and one of two apertures 42 on the bolt extension 22 according to backset requirements of the latch 10. It is to be understood that the bolt extension 22 may be fixedly secured to the bolt 20 forming an integral part thereof although the adjustability between the bolt 20 and extension 22 accommodates a greater number of applications. The bolt extension 22 also includes an engagement opening 44 having at least one engagement edge 46.

The engagement opening 44 of the bolt extension 22 receives the end portion 48 of the actuating cam 24 such that as the cam 24 is pivoted back and forth the bolt extension 22 and the bolt 20 will be shifted between retracted and extended positions. The cam 24 includes a hub portion 50 about which the actuating cam 24 pivots and which includes a lateral bore 52 adapted to receive the control rod of the operating handle. The end portion 48 of the cam 24 includes an abutment surface 54 and an interlock shoulder 56. The end abutment surface 54 cooperates with the engagement edge 46 of the opening 44 in the bolt extension 22 to hold the latch in the fully retracted position and the interlock shoulder 56 cooperates with the engagement edge 46 of the opening 44 to maintain the latch 10 in a "loaded" position as will be subsequently described. The hub portion 50 of the cam 24 includes a plurality of camming surfaces 58 to facilitate positioning of the actuating cam 24. The lower camming surfaces 58 engage the housing 16 while the upper camming surfaces 58 are engaged by a beam spring 60 which urges the cam 24 towards the extended position. In a first embodiment (FIGS. 2–8), the beam spring 60 is attached to the housing 16. In a second embodiment (FIG. 9), the beam spring 60 is attached to the bolt extension 22 and moves with the bolt 20. In both embodiments, the beam spring 60 is maintained in contact with the cam 24 to act against the camming surfaces 58.

Figure 4:
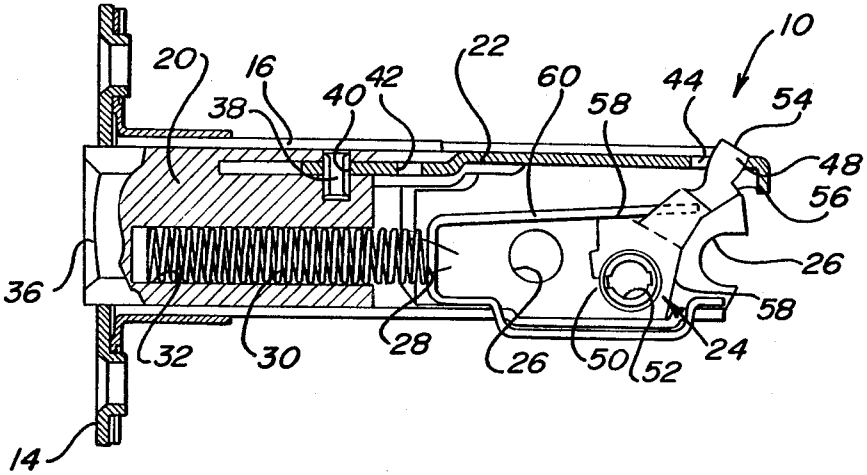
FIG. 4 is a cross-sectional view of the latch in a second position moving towards a loaded position.
Figure 5:
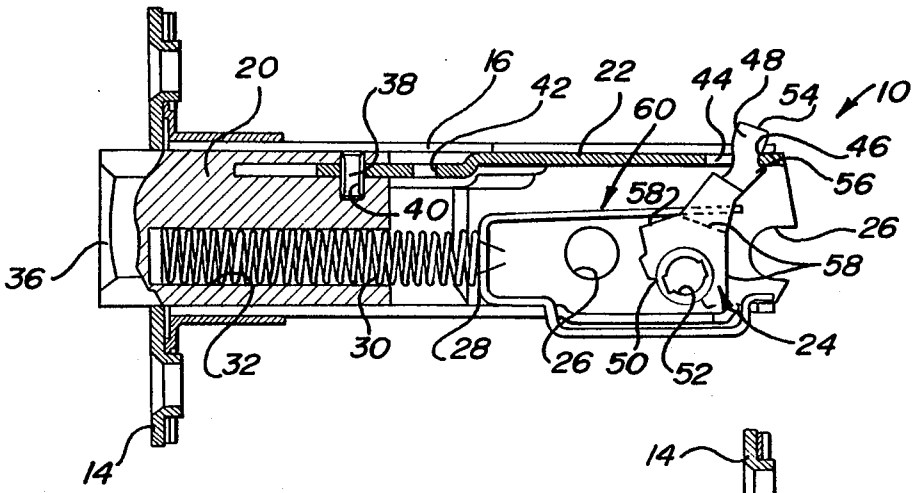
FIG. 5 is a cross-sectional view of the latch in the loaded position prepared for selective self-locking upon closure of the entry door.

The latch mechanism 10 of the present invention allows selective self-locking of the bolt 20 such that upon closing the door 12 the bolt 20 will be fully extended without engaging the opening means of the latch 10. Referring now to FIGS. 3–7, the sequential steps of the self-locking latch 10 are shown therein. At the fully retracted position of FIG. 3, as the latch will be positioned after unlocking, the end of the bolt 20 is substantially flush with the face plate 14 and the actuating cam 24 is pivoted inwardly from the door's edge. The bolt 20 is maintained in this position by the force exerted by the compression spring 30 which engages edge 46 of the extension opening 44 against the end abutment surface 54 of the cam 24. The latch 10 remains in this position until the bolt 20 is adjusted to release the end surface 54. In a preferred embodiment, this is accomplished by rotating the turn lever of the latch slightly to partially extend the bolt 20. Alternatively, the latch 10 can be loaded by depressing the end of the bolt 20. The cam 24 moves forward slightly as a result of the pressure exerted by the beam spring 60 against the corner of the camming surface 58 which lies forward of the pivoting center of the cam hub 50. As shown in FIG. 4, the beam spring 60 acting on the flat camming surface 58 temporarily holds the cam 24. The force of the compression spring 30 causes the bolt 20 to move towards the loaded position carrying the cam 24 along until the interlock shoulder 56 engages the opening 44 of the bolt extension 22 as shown in FIG. 5.

Figure 6:
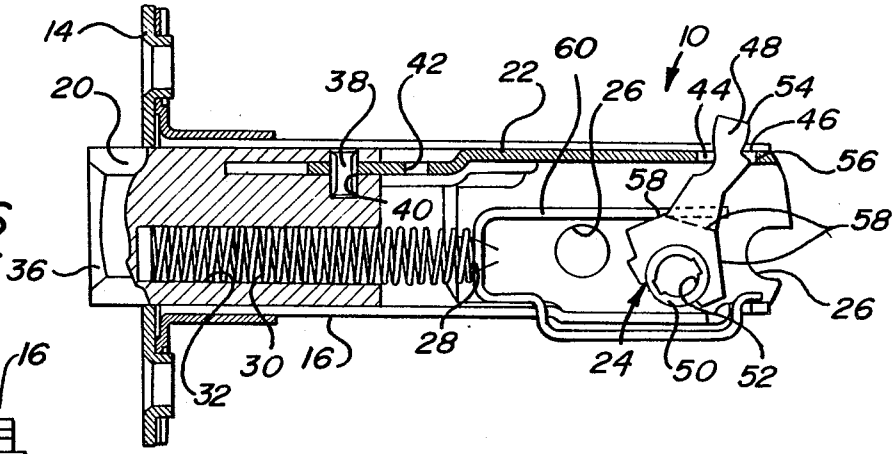
FIG. 6 is a cross-sectional view of the latch following engagement with the strike plate moving towards full extension.
Figure 7:
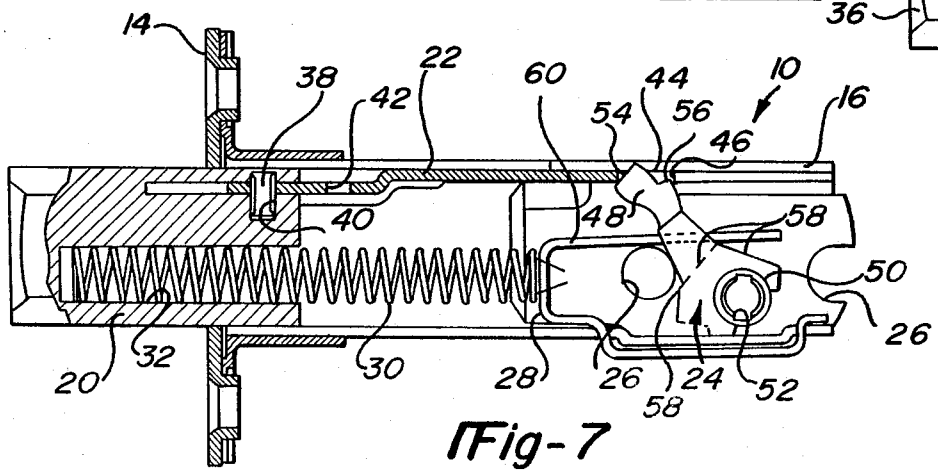
FIG. 7 is a cross-sectional view of the latch in the fully extended or locked position.

The latch 10 is now "loaded" for self-locking upon closing the door 12. As is shown in FIG. 5, the bolt 20 will extend partially beyond the face plate 14 while the cam 24 is interlocked against further movement by the engagement of the interlock shoulder 56 with the opening 44 of the extension 22. As the door 12 is closed and the bolt 20 engages the door strike, the bolt 20 will be depressed moving the extension 22 inwardly releasing the interlock shoulder 56 of the cam 24. Upon release of the cam 24, the beam spring 60 acting on the camming surfaces 58 will urge the actuating cam 24 forward as shown in FIG. 6. The force of the compression spring 30 will extend the bolt 20 into the strike plate while the beam spring 60 and bolt extension 22 rotate the cam 24 towards the extended position of FIG. 7. With the bolt 20 fully extended, the lower camming surfaces 58 engage the housing 16 to prevent further rotation of the actuating cam 24. Additionally, the beam spring 60 acts upon the upper camming surfaces 58 to maintain the latch 10 in the fully extended or locked position. The latch 10 can be unlocked using the operating handle or key to move the cam 24 and bolt 20 to the fully retracted position of FIG. 3. Thus, the present invention provides a latch mechanism which can be selectively positioned for self-locking upon closing of the door 12. Of course, the latch 10 can be utilized in the conventional manner to lock the latch 10 once the door has been closed.

Figure 9:
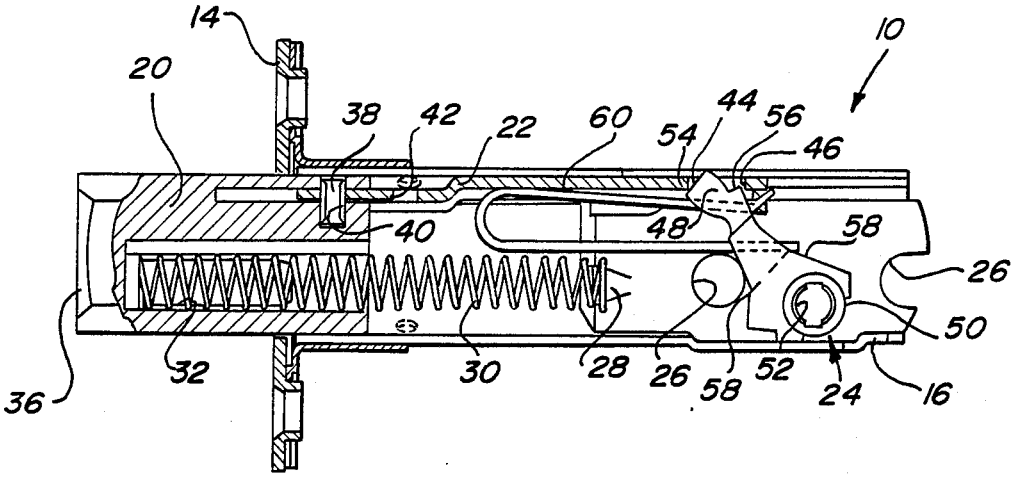
FIG. 9 is a cross-sectional view of a still further embodiment of the latch of the present invention.
Figure 8:
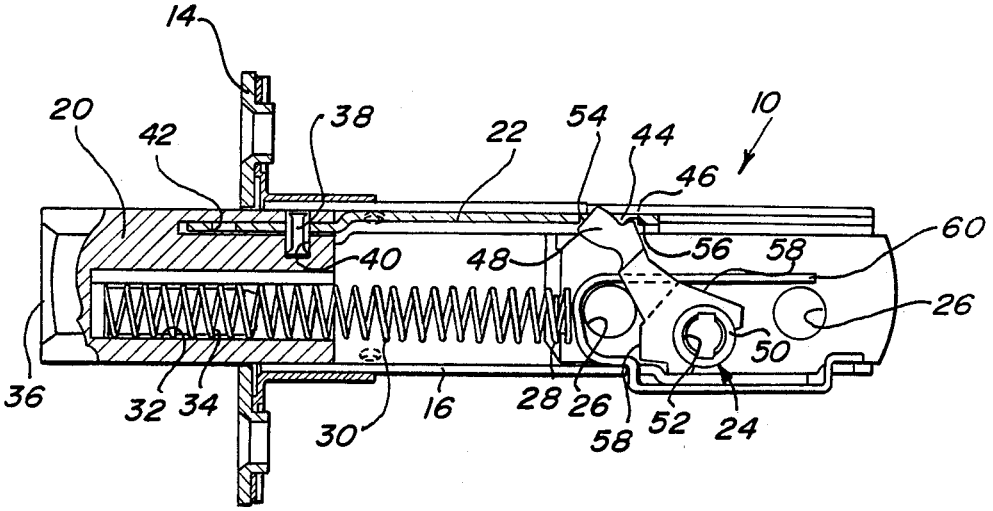
FIG. 8 is a cross-sectional view of a further embodiment of the latch having a different backset distance.

FIG. 8 shows the latch mechanism 10 of the present invention with a housing 16 for a $2\frac{3}{8}$ backset in contrast to the $2\frac{3}{4}$ backset of the latch of FIGS. 1–7. To accommodate the smaller backset the bolt extension 22 is adjusted for less length by using the second of the openings 42 to receive the pin 38. FIG. 9 shows the self-locking latch 10 with the beam spring 60 attached to the bolt extension 22.

The foregoing detailed description has been given for clearness of understanding only and no unnecessary limitations should be understood therefrom as some modifications will be obvious to those skilled in the art without departing from the scope and spirit of the appended claims:

I claim:

1. A selectively self-locking latch mechanism adapted to be mounted within a door for latching the door, said latch mechanism selectively cooperable with a door strike, said latch mechanism comprising:

a latch housing;

a bolt selectively movable within said housing between a retracted position and an extended position;

an actuating cam disposed within said housing and operable on said bolt to move said bolt between said retracted and extended positions, said cam movable between a first position corresponding to said retracted position of said bolt and a second position corresponding to said extended position of said bolt such that upon rotation of said actuating cam said bolt will move between said retracted and extended positions, said cam including means for interlocking said cam and bolt in a loaded position intermediate said retracted position and said extended position of said bolt; and means for urging said actuating cam towards said second position;

said bolt movable from said loaded position to said extended position as said bolt engages the strike upon closing the door disengaging said interlock means of said cam, said cam and bolt selectively positionable in said loaded position.

2. The latch mechanism as defined in claim 1 wherein said bolt includes a bolt extension, said actuating cam engaging said bolt extension to move said bolt extension and bolt between said retracted and extended positions.

3. The latch mechanism as defined in claim 2 wherein said means for interlocking said cam in said loaded position comprises a shoulder formed on said actuating cam, said shoulder releasably cooperable with said bolt extension.

4. The latch mechanism as defined in claim 3 wherein said bolt extension includes an opening receiving said actuating cam, said shoulder engaging an edge of said opening to releasably retain said cam and bolt in said loaded position.

5. The latch mechanism as defined in claim 4 wherein said actuating cam includes an end abutment surface, said end surface engaging an edge of said bolt extension opening to releasably retain said cam and bolt in said retracted position.

6. The latch mechanism as defined in claim 1 wherein said urging means comprises a spring attached to said housing and engaging a hub of said actuating cam, said hub of said cam including a plurality of camming surfaces selectively engageable by said spring to urge said actuating cam towards said second position to extend said bolt.

7. The latch mechanism as defined in claim 1 and further comprising a compression spring extending into said bolt and engaging said housing, said compression spring urging said bolt and bolt extension towards said extended position.

8. The latch mechanism as defined in claim 6 wherein said latch housing includes a pair of housing halves, said housing halves having aligned apertures to rotatably receive said hub of said actuating cam.

9. The latch mechanism as defined in claim 6 wherein said spring is attached to said bolt extension.

10. A selectively self-locking latch mechanism mountable within a door and having rotatable operating means, said latch mechanism selectively cooperable with a door strike, said latch mechanism comprising:

a latch housing having at least one set of aligned apertures;

a bolt selectively movable within said housing between a retracted position and an extended position;

a bolt extension connected to said bolt and shiftable with said bolt, said extension including at least one opening having an engagement edge;

an actuating cam disposed within said housing and operable on said bolt extension to move said bolt between said retracted and extended positions, said cam including an end portion extending into said opening of said bolt extension and a pivot hub coaxial with the rotational axis of the operating means, said hub rotatably received within said apertures of said housing, said cam pivotable between a first position corresponding to said retracted position of said bolt and a second position corresponding to said extended position of said bolt such that upon rotation of the operating means said cam will pivot to move said bolt between said retracted and extended positions;

an interlock shoulder formed on said actuating cam for maintaining said cam and said bolt in a loaded position intermediate said retracted position and said extended position of said bolt, said interlock shoulder releasably engaging said edge of said opening in said bolt extension to releasably maintain said latch in said loaded position; and a beam spring disposed within said housing, a first end of said beam spring engaging said hub of said actuating cam to urge said cam towards said second position;

said cam and bolt selectively positionable in said loaded position such that said interlock shoulder of said cam releasably engages said edge of said bolt extension opening, said bolt movable from said loaded position to said extended position as said bolt engages the door strike upon closing the door disengaging said interlock shoulder of said cam from said engagement edge.

11. The latch mechanism as defined in claim 10 wherein said end portion of said actuating cam includes an end abutment surface, said end surface engaging said edge of said bolt extension opening to releasably retain said cam and bolt in said retracted position.

12. The latch mechanism as defined in claim 10 wherein said hub of said actuating cam including a plurality of camming surfaces selectively engageable by said beam spring to urge said actuating cam towards said second position to extend said bolt.

13. The latch mechanism as defined in claim 12 wherein a second end of said beam spring is secured to said latch housing.

14. The latch mechanism as defined in claim 11 wherein said bolt includes a compression spring urging said bolt and bolt extension towards said extended position, a first end of said compression spring engaging said bolt and a second end of said compression spring engaging said housing.

15. In a latch mechanism mountable within a door and having a housing, a bolt shiftable between extended and retracted positions, a bolt extension connected to the bolt, an actuating cam operating on the bolt extension for shifting the bolt between the extended and retracted positions, operating means for actuating the latching mechanism and having a rotatable rod which extends through the hub of said actuating cam for rotation thereof, the improvement comprising:

interlock means for maintaining the cam and the bolt in a loaded position intermediate said retracted position and said extended position of the bolt; and means for urging the actuating cam towards the extended position;

said cam and bolt selectively positionable in said loaded position to engage said interlock means, said bolt movable from said loaded position to said extended position as said bolt engages a door strike upon closing the door disengaging said interlock means.

16. The latch mechanism as defined in claim 15 wherein said interlock means comprises an interlock shoulder formed on the actuating cam selectively cooperable with the bolt extension to maintain the cam and bolt in said loaded position.

17. The latch mechanism as defined in claim 16 wherein said urging means comprises a beam spring engaging a hub of the actuating cam, said hub including a plurality of camming surfaces engaged by said beam spring.

18. The latch mechanism as defined in claim 16 wherein the bolt includes an axial compression spring biasing the bolt towards the extended position.

* * * * *